US009071908B2

(12) United States Patent
Väisänen et al.

(10) Patent No.: US 9,071,908 B2
(45) Date of Patent: Jun. 30, 2015

(54) LOUDSPEAKER WITH A WAVE GUIDE

(71) Applicant: Genelec Oy, Iisalmi (FI)

(72) Inventors: Jussi Väisänen, Iisalmi (FI); Ilpo Martikainen, Iisalmi (FI)

(73) Assignee: Genelec Oy, Iisalmi (FI)

( * ) Notice: Subject to any disclaimer, the term of this patent is extended or adjusted under 35 U.S.C. 154(b) by 0 days.

(21) Appl. No.: 14/305,005

(22) Filed: Jun. 16, 2014

(65) Prior Publication Data

US 2014/0369543 A1 Dec. 18, 2014

(30) Foreign Application Priority Data

Jun. 14, 2013 (FI) ..... 20135654

(51) Int. Cl.

| | |
|---|---|
| ***H04R 1/34*** | (2006.01) |
| ***H04R 1/02*** | (2006.01) |
| ***H04R 1/32*** | (2006.01) |
| ***H04R 1/40*** | (2006.01) |
| *H04R 1/24* | (2006.01) |
| *H04R 1/26* | (2006.01) |

(52) U.S. Cl.

CPC ..... *H04R 1/345* (2013.01); *H04R 1/023* (2013.01); *H04R 1/24* (2013.01); *H04R 1/26* (2013.01); *H04R 1/323* (2013.01); *H04R 1/403* (2013.01)

(58) Field of Classification Search

CPC ..... H04R 1/00; H04R 1/28; H04R 1/30; H04R 9/00; H04R 1/2807; H04R 1/2865; H04R 1/2815–1/2826; H04R 2205/022; H04R 2201/401; H04R 2201/405

USPC ..... 381/337–342, 345–346, 349, 351, 182, 381/396

See application file for complete search history.

(56) References Cited

U.S. PATENT DOCUMENTS

| | | | | |
|---|---|---|---|---|
| 5,216,210 | A * | 6/1993 | Kammer | 381/349 |
| 6,782,112 | B1 * | 8/2004 | Geddes | 381/349 |
| 7,477,755 | B2 * | 1/2009 | Saiki et al. | 381/349 |
| 8,842,868 | B1 * | 9/2014 | Hsu Huang et al. | 381/349 |
| 2001/0024508 | A1 | 9/2001 | Croft | |
| 2009/0050402 | A1 | 2/2009 | Shinohara et al. | |

* cited by examiner

*Primary Examiner* — Suhan Ni
(74) *Attorney, Agent, or Firm* — Seppo Laine Oy

(57) ABSTRACT

The present invention relates to a loudspeaker including a first driver, which is configured to produce a first frequency band and a corresponding first acoustic axis, a second driver, which is configured to produce a second frequency band, which is different from the first frequency band but may overlap in a crossover region, and which second frequency band has a second acoustic axis, and an enclosure enclosing said drivers and comprising a three dimensional wave guide positioned on a front surface of the enclosure and around the first driver. In accordance with the invention the three dimensional waveguide comprises an acoustically selectively transparent portion which is acoustically essentially reflecting to sound waves of the first frequency band propagating in a direction angled to the first acoustic axis, the waveguide portion is essentially transparent to sound waves of the second frequency band propagating in the direction of the second acoustic axis through the waveguide portion, and in that the second driver is positioned inside the enclosure behind the acoustically selectively transparent portion.

20 Claims, 2 Drawing Sheets

LOUDSPEAKER WITH A WAVE GUIDE

FIELD OF THE INVENTION

The present invention relates to loudspeakers. In particular, the present invention relates to loudspeakers with a wave guide.

To be exact, the present invention relates to the preamble e portion of claim 1.

PRIOR ART

In the prior art especially loudspeakers with two or more drivers have had problems with diffractions created by discontinuities on the front surface (Face) of the loudspeaker. In practice the high frequency driver (tweeter) has been the most critical part in this relation and the applicant of the present application has created solutions where the surroundings of the tweeter have been created as a continuous wave guide for high and mid range audio signals either merely for a tweeter or alternatively for a coaxial mid-high range driver.

In this application these kind of sound sources are referred as a wave guide drivers including any drivers being in the centre of this three dimensional wave guide structure. By these solutions good sound quality and accurate directioning of the sound energy may be achieved. However, the frequency range of this directioning depends on the size of the wave guide and therefore on the front surface (Face) of the loudspeaker. With small waveguide areas the directivity is limited to higher frequencies like tweeter range only.

If a smaller loudspeaker is designed, the other drivers not positioned in the center of the waveguide (like woofer) will either limit the area of the wave guide or additionally create harmful diffractions audible to the listener.

In the prior art there have been attempts to create a loudspeaker with a waveguide on the front side of the loudspeaker. The applicant of the present application has created various solutions for this purpose, however not for the complete front surface (Face) of the enclosure.

AIM OF THE INVENTION

In accordance with the invention at least some of the problems described above are solved by positioning any non-coaxial drivers such that they are not disturbing the wave guide form of the front surface (Face) of the enclosure and if positioned on the same surface (the front side (Face) of the enclosure) they are covered with a material that functions advantageously as a solid surface and restricts penetration of the frequencies emitted by the sound source(s) for which the wave guide is designed for the frequencies of the sound source for which the wave guide is designed for and on the other hand be permeable for frequencies the non-coaxial driver, typically woofer emits.

More specifically, loudspeaker according to the invention is characterized by what is stated in characterizing portion of claim 1.

According to one embodiment of the invention, two woofers are positioned on the front surface (Face) of the enclosure such that they are on both sides of the coaxial driver, which includes elements both for mid- and high frequencies. The woofers are typically positioned such that they are radiating through an acoustically transparent layer passing the low frequencies, however being essentially non permeable to and at least essentially limiting penetration of higher frequencies emitted by the coaxial driver. The acoustically transparent layer is formed as a part of a wave guide on the front surface (Face) of the enclosure.

According to a further embodiment of the invention, the layer used for forming the acoustically transparent layer is of porous material like felt or of expanded plastic with open cell structure or fabric.

ADVANTAGES GAINED WITH THE INVENTION

Considerable advantages are gained with the aid of the present invention.

With help of the invention the entire front surface (Face) of the loudspeaker can be formed as a continuous waveguide for mid- and high frequencies. By this measure the whole audio range from 18-20000 Hz may be directed precisely to one "sweet spot" and in addition the rest of the sound energy is divided to the listening room due to the full waveguide form of the loudspeaker such that the loudspeaker enclosure itself does not essentially affect to the frequency response in other directions than the main direction.

In other words, in the traditional loudspeakers where the complete baffle plate is either planar or only partly curved as a wave guide, the signal formed into other directions than the "sweet spot" will be reflected from the walls of the listening room in a non controlled manner The invention however provides an enclosure where the sound pressure is optimally distributed to all directions, whereby also the wall reflections sound natural to human ear.

BRIEF DESCRIPTION OF DRAWINGS

In the following, certain preferred embodiments of the invention are described with reference to the accompanying drawings, in which.

DESCRIPTION OF PREFERRED EMBODIMENTS

Figure 1:
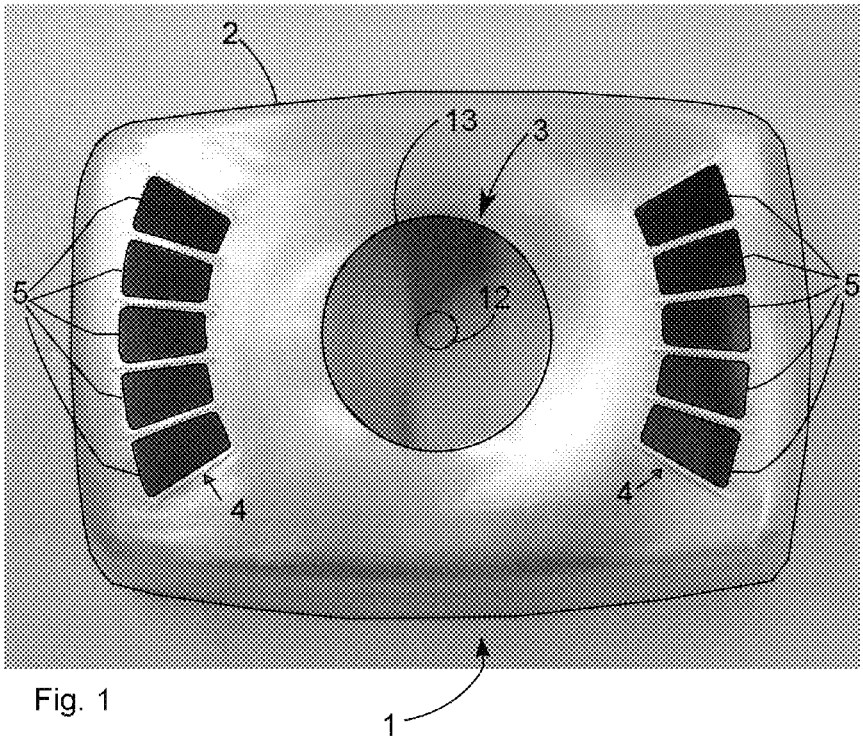
FIG. 1 presents a front view of a loudspeaker according to one preferred embodiment of the invention.

List of used terms:

1 loudspeaker
2 enclosure
3 wave guide driver, also coaxial drive or tweeter only
4 woofer, low frequency driver
5 openings for the woofer, low frequency driver
6 acoustically selectively transparent layer
7 support structure for the acoustically transparent layer
8 three dimensional wave guide surface, also a front surface (Face) of the enclosure 2 radiating the acoustic power having a smooth continuous surface with axially symmetrical features around the centre of the wave guide driver 3
9 sweet spot for multiple loudspeakers
10 first acoustic axis
11 second acoustic axis
12 tweeter
13 mid range driver B1 frequency band of the wave guide driver 3
B2 frequency band of non-coaxial driver 4
C cross over frequency band between bands B1 and B2

In accordance with FIG. 1 one embodiment of the invention the loudspeaker 1 includes a coaxial wave guide driver 3 comprising a tweeter 12 and a mid range driver 13 around it. The coaxial driver 3 is positioned in the centre of the three dimensional wave guide surface 8, also a front surface (Face) of the enclosure 2. The wave guide surface 8 radiates the acoustic power of the driver 3. The wave guide 8 has a smooth continuous surface with axially symmetrical features around the centre of the wave guide driver 3. Two woofer elements 4 are positioned on both sides of the wave guide driver 3 and suitable openings 5 are formed for the woofers 4 in order to let the acoustic energy out from the enclosure 2.

Figure 2:
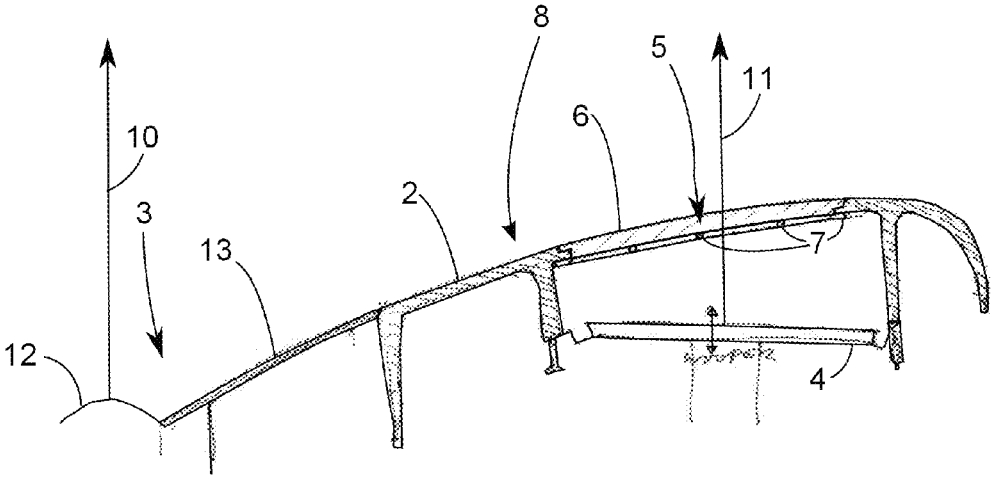
FIG. 2 presents a cross section of a loudspeaker according to FIG. 1.

With reference to FIG. 2, the openings 5 are covered with an acoustically transparent layer 6 forming part of the wave guide surface 8. If needed the acoustically transparent layer 6 may be supported from below with support bars 7. The woofer element 4 is typically spaced from the acoustically transparent layer 6.

Referring to FIG. 1 the two woofers 4 form an equivalent large woofer radiating essentially along the same acoustic axis 10 as the wave guide driver 3 even though the woofers have their own acoustic axis 11.

In other words the loudspeaker 1 includes a first driver 3, which is configured to produce a first frequency band B1 and a corresponding first acoustic axis 10, and a second driver 4, which is configured to produce a second frequency band B2, which is different from the first frequency band B1 but may overlap in a cross-over region, and which second frequency band B2 has a second acoustic axis 11. The enclosure 2 encloses said drivers 3, 4 and comprises a three dimensional wave guide 8 positioned on a front surface of the enclosure 2 and around the first driver 3. The three dimensional waveguide 8 comprises an acoustically selectively transparent portion 6 which is acoustically essentially reflecting to sound waves of the first frequency band B1 propagating in a direction angled to the first acoustic axis 10, the waveguide portion 6 is essentially transparent to sound waves of the second frequency band B2 propagating in the direction of the second acoustic axis through the waveguide portion 6, and the second driver 4 is positioned inside the enclosure 2 behind the acoustically selectively transparent portion 6.

As described above the second acoustic axis 11 of individual woofer elements is non-coaxial with the first acoustic axis 10, however the resultant axis equivalent woofer element) has the same acoustic axis as the coaxial driver, wave guide driver 3. This symmetry is however not required in all embodiments of the invention.

Typically the second driver 4 is positioned inside the enclosure 2 behind the acoustically selectively transparent portion 6 and spaced from it.

Figure 3:
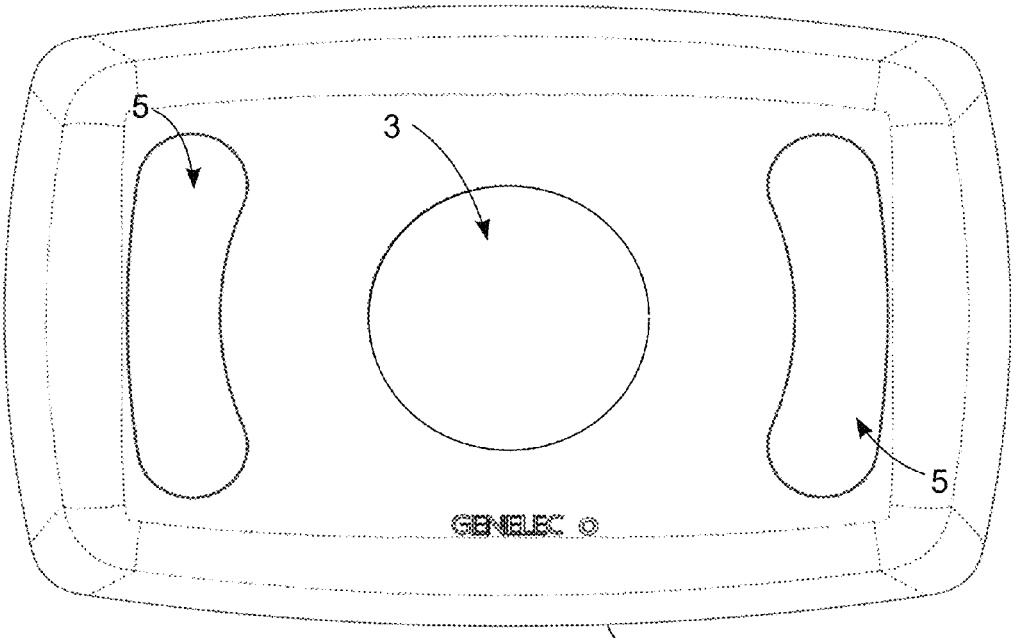
FIG. 3 represents a front view of a loudspeaker according to another preferred embodiment of the invention.

FIG. 3 shows another embodiment of the invention where the openings 5 have been combined as large rounded openings.

Figure 4:
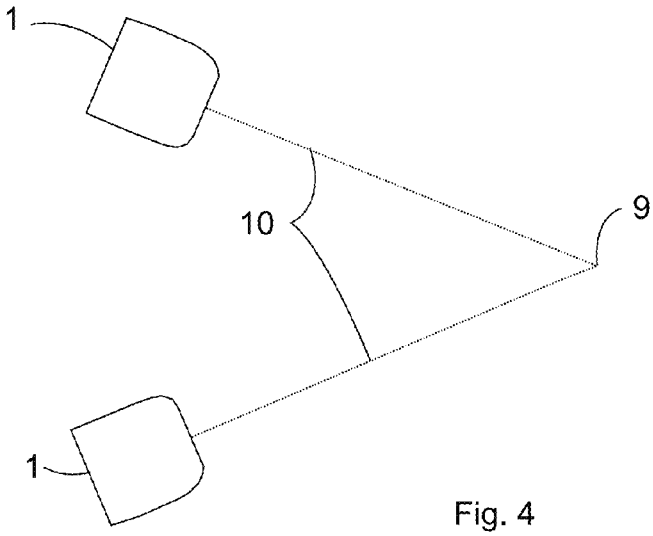
FIG. 4 represents as a top view a principal wave propagation view in accordance with the invention when used with 2 loudspeakers.

FIG. 4 shows the typical positioning of the loudspeakers 1 in accordance with the invention, where the loudspeakers are directed to the listening position, sweet spot 9. Due to the fact that the complete front surface of the enclosure 2 is formed as a wave guide 8, a very good directivity is achieved. Additionally the wave guide form 8 causes a uniform distribution of all frequencies to all directions in the listening room and therefore the reflections from the walls, ceiling and floor cause no coloration of the sound.

In connection with the acoustically selectively transparent layer 6 essentially reflecting means reflection or absorption of at least 50-100% of the acoustic energy, preferably in the range of 80-100%.

In the same way essentially transparent means transparency of at least 50-100% of the acoustic energy preferably in the range of 80-100%.

In the following additional advantageous properties of the acoustically selectively transparent layer 6 are presented:

The thickness of the layer 6 is advantageously:
- felt, about 1 . . . 5 mm thick
- open cell plastic foam, about 1-20 mm thick, pore diameter less than 1 mm
- thin fabrics as such or as a part of the layer 6

The layer 6 should attenuate the acoustical radiation of the wave guide driver 3, meaning typically in frequencies above 600 Hz.

In other words the layer 6 should have an acoustical impedance (or absorption) as a function of frequency therefore functioning as an acoustical filter in the following way:
- lowpass when the sound from woofer element 4 is going through
- attenuation (e.g. caused by turbulence or absorption with high losses) for high frequencies from waveguide driver 3 causing strong reflection of the acoustic waves at mid and high frequencies
- high reflectance for high frequencies of the driver 3

Advantageously the layer 6 is formed of holes or pores or their combination in the following way:
- if single layer 6 is used holes should have smaller diameter than 1 mm
- if multiple layers 6 are used holes with diameter smaller than 1 mm, may work
- also, if multiple layers 6 are used holes with diameter larger than 1 mm, may work (not tested yet)
- microstructure like felt and open celled plastic work The properties for the ideal material fur layer 6 are the following:
- gas permeable (=porous)
- low acoustical losses up to the crossover frequency C (woofer 4)
- high acoustical reflectance slightly above the crossover frequency c
- known materials fulfilling the above criteria:
  - felt, about 1 . . . 5 mm thick
  - open cell plastic foam, about 1-20 mm thick, pore diameter less than 1 mm The layer 6 may cover the loudspeaker front (tweeter 12 excluded) or only the holes 5.

The layer 6 may be also formed as a metal structure, like mesh or grid with on one or several layers in accordance with the above requirements for porosity and frequency properties. This kind of structure could be formed e.g. by a stack of perforated metal sheets or plates of thickness around 0.2-2 mm. The properties of this kind of stack could be adjusted by placement (distribution) of the holes or pores, percentage (openness) of the holes or pores, and the spacing of the plates from each other. The hole or aperture diameter may vary typically around 0.3-3 mm. The spacing between the sheets or plates is typically around 0.2-2 mm.

A metal structure described above is advantageous, because its propertied can be adjusted freely and the external properties like colour can be as well selected without limitations.

The crossover frequency C is typically the following:

low frequency f<600 Hz (woofer output range)

high frequency f>600 Hz (midrange and/or tweeter output range)

In accordance with the invention in combination with the large waveguide 8:

woofer 4 is placed behind the waveguide surface 8 two or more (e.g. 4) woofers 4 can be used in order to obtain directivity

Also an embodiment with only one woofer is possible, however directivity for low frequencies will not be obtained.

The invention claimed is:

1. A loudspeaker (1) including a first driver, which is configured to produce a first frequency band and a corresponding first acoustic axis, a second driver, which is configured to produce a second frequency band, which is different from the first frequency band but may overlap in a cross-over region, and which second frequency band has a second acoustic axis, and an enclosure enclosing said drivers and comprising a three dimensional wave guide positioned on a front surface of the enclosure and around the first driver, wherein the three dimensional waveguide comprises an acoustically selectively transparent portion which is acoustically essentially reflecting to sound waves of the first frequency band propagating a direction angled to the first acoustic axis, the selectively transparent portion is essentially transparent to sound waves of the second frequency band propagating in the direction of the second acoustic axis through the selectively transparent portion, and in that the second driver (4) is positioned inside the enclosure behind the acoustically selectively transparent portion.

2. A loudspeaker in accordance with claim 1, wherein the second acoustic axis is non-coaxial with the first acoustic axis.

3. A loudspeaker in accordance with claim 1, wherein the second driver is positioned inside the enclosure behind the acoustically selectively transparent portion and spaced from it.

4. A loudspeaker in accordance with claim 1, wherein it includes two second drivers positioned around the first driver.

5. A loudspeaker in accordance with claim 1, wherein it includes our second drivers positioned around the first driver.

6. A loudspeaker in accordance with claim 1, wherein it includes multiple second drivers positioned around the first driver.

7. A loudspeaker in accordance with claim 1, wherein the second drivers are positioned axially symmetrically around the first driver.

8. A loudspeaker in accordance with claim 1, the selectively transparent portion is of porous material.

9. A loudspeaker in accordance with claim 1, wherein the selectively transparent portion is of porous material where the pore diameter is smaller than 1mm.

10. A loudspeaker in accordance with claim 1, wherein the selectively transparent portion is of felt with a thickness of 1-5 mm.

11. A loudspeaker in accordance with claim 1, wherein the selectively transparent portion is of open cell plastic foam with a thickness of 1-20 mm.

12. A loudspeaker in accordance with claim 1, wherein the selectively transparent portion covers the complete loudspeaker front surface the tweeter excluded.

13. A loudspeaker in accordance with claim 1, wherein the selectively transparent portion covers only the openings.

14. A loudspeaker in accordance with claim 1, wherein the first driver includes two coaxial drivers.

15. A loudspeaker in accordance with claim 1, wherein the first driver includes only one driver.

16. A loudspeaker in accordance with claim 1, wherein the selectively transparent portion is made of metal.

17. A loudspeaker in accordance with claim 1, wherein the selectively transparent portion is made of metal mesh.

18. A loudspeaker in accordance with claim 1, wherein the selectively transparent portion is made of metal mesh of several layers.

19. A loudspeaker in accordance with claim 1, wherein the selectively transparent portion is made of metal sheets of several layers with perforations.

20. A loudspeaker in accordance with claim 1, wherein the selectively transparent portion is made of sheets spaced from each other in range of 0.2-2 mm.

* * * * *